United States Patent [19]

Wu

[11] Patent Number: 4,913,327

[45] Date of Patent: Apr. 3, 1990

[54] BURGLARPROOF DEVICE FOR CARRYING PERSONAL BANK NOTES

[76] Inventor: Shih-fu Wu, 2nd Floor, 108, Kweilin Road, Taipei, Taiwan

[21] Appl. No.: 256,032

[22] Filed: Oct. 11, 1988

[51] Int. Cl.[4] ..... A45F 5/00

[52] U.S. Cl. ..... 224/247; 224/250; 224/253; 24/115 H

[58] Field of Search ..... 224/229, 247, 248, 249, 224/250, 253, 254, 271, 907; 150/133, 137, 140; 24/115 H, 30.5 R, 481, 428, 129 R

[56] References Cited

U.S. PATENT DOCUMENTS

| | | | |
|---|---|---|---|
| 673,574 | 5/1901 | Deovich | 150/137 |
| 1,438,145 | 12/1922 | Swartz | 224/250 |
| 1,471,484 | 10/1923 | Humphreys | 150/140 |
| 2,713,706 | 7/1955 | Biagi | 24/115 H |
| 3,286,751 | 11/1966 | Dishart | 224/253 |

FOREIGN PATENT DOCUMENTS

| | | | |
|---|---|---|---|
| 243675 | 3/1965 | Austria | 24/115 H |

*Primary Examiner*—Linda J. Sholl

*Attorney, Agent, or Firm*—Asian Pacific Inernational Patent & Trademark Office

[57] ABSTRACT

A safety bank note holder for carrying personal bank notes, comprising a rectangular plate and a rope, said rectangular plate being formed with two holes respectively at two ends thereof, permitting the rope to be conducted therethrough to wind up the plate so as to let bank notes bound up between the plate and the rope. A retaining ring can be pre-arranged in the pocket of a user's clothes to connect the rope, whereby the bank notes are securely placed in the pocket, and can be easily pulled out for use.

2 Claims, 4 Drawing Sheets

BURGLARPROOF DEVICE FOR CARRYING PERSONAL BANK NOTES

BACKGROUND OF THE INVENTION

Generally, people may need to carry bank notes with themselves when going out. However, while carrying bank notes, people always need to pay much attention to preventing the bank notes from being lost. Regularly, for easy carry, people may use a handbag, purse, wallet, or paper or cloth bag to contain the bank notes. However, using conventional wrappers or containers for carrying bank notes may cause some inconveniences and disadvantages. For instance, carrying a handbag may easily make the hand ache. If a purse or wallet is placed inside the clothes, it may protrude the pocket, making the user feel heavy, uncomfortable and inconvenient. In order to get rid of the shortcomings above described, many people may simply carry the bank notes in the pocket without using the wrappings of paper or cloth bag or any other packing material. However, by means of any conventional means to carry personal bank notes it may either add troubles to the owner of the bank notes or the bank notes may be easily lost.

After long time of experimentation, a novel design of burglarproof device for carryihng personal bank notes is thus created, which comprises a rope and a rectangular plate. Said rectangular plate is formed with one hole at each ends for said rope to insert therethrough and revolve therearound. This invention is to prevent the inconveniences and troubles aforesaid, permitting the bank notes to be always kept with the body safely.

SUMMARY OF THE INVENTION

It is a primary object of the present invention to provide a safety bank note holder for carrying personal bank notes, which binds up bank notes by means of loosening the rope, wound on a rectangular plates folding the bank notes in two, and inserting the bank notes through the rope. According to this arrangement, the bank notes are bound up by the assembly of said rope and rectangular plate which is affixed to a user's clothes to provide burglarproof effect.

It is a further object of the present invention to provide a simple safety bank note holder for carrying to provide two or more the above holders for carrying personal bank notes, permitting the bank notes of various value to be respectively bound up by corresponding holders, so as not to let the bank notes exposed.

DETAILED DESCRIPTION OF THE PREFERRED EMBODIMENTS

Figure 1:
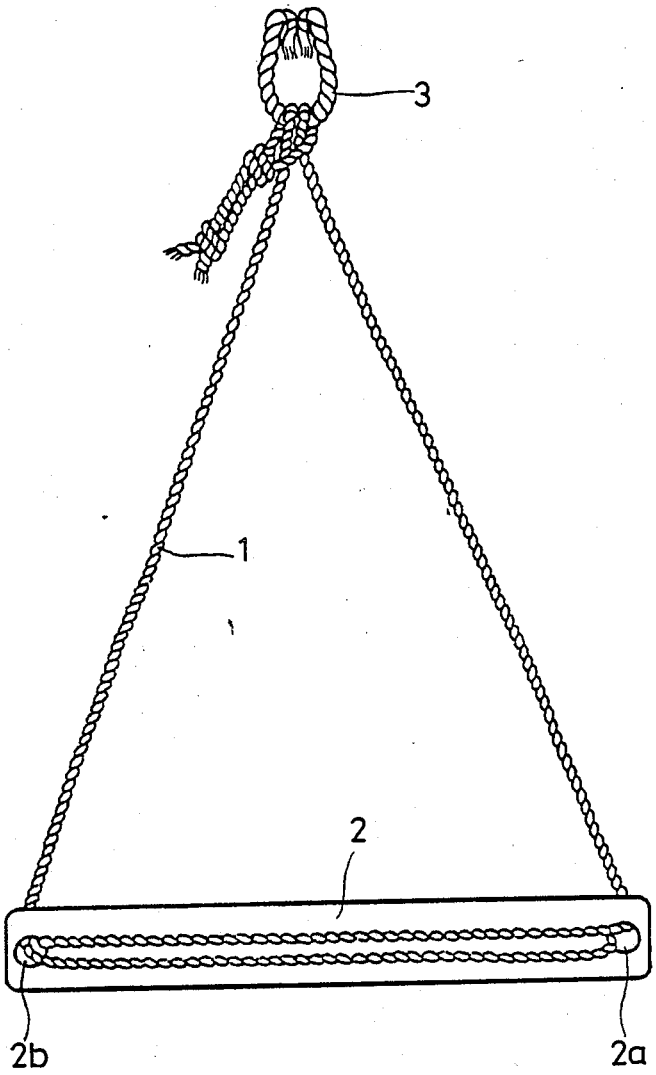
FIG. 1 is a front view of one embodiment of the present invention.
Figure 2:
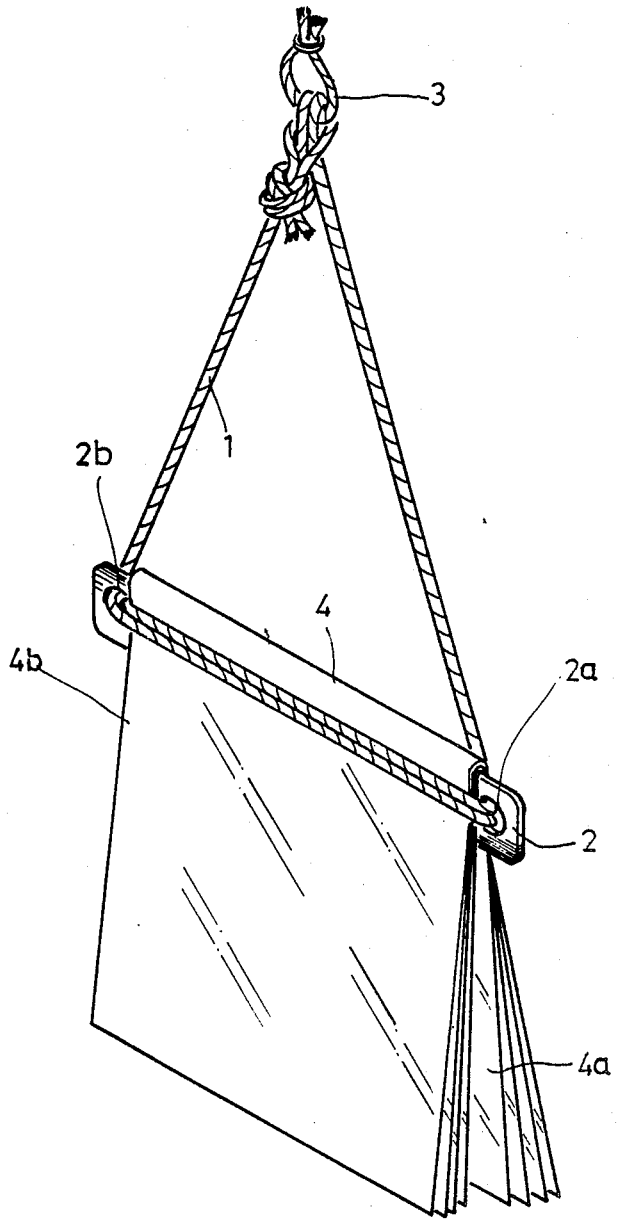
FIG. 2 is a front perspective view showing the folded bank notes bound into a bank note book by the present invention.

Referring to FIG. 1 and FIG. 2, the present invention includes a thin elastic long rectangular plate 2 and a rope 1 having two ends. The plate 2 has a front face, a rear face, a first end formed with a first hole **2*b* and a second end formed with a second hole 2*a*. The rope 1 is loosely tied to the plate 2 in such a manner that one end of the rope 1 is conducted through the first hole 2*b* from the rear face to the front face of the plate 2, and drawn along the front face toward the second holes 2*a* and conducted through the second holes back to the rear face, and then drawn along the rear face toward the first hole 2*b* and again conducted through the first hole 2*b* to the front face and them again drawn along the front face toward the second hole 2*a* and again conducted through the second hole 2*a* back to the rear face and tied with the other end of the two ends of the rope 1, forming a knot, whereby a single segment of the rope 1 is formed on the rear face and a double segment of the rope 1 is formed on the front face, permitting bank notes 4 to be folded in two and ride on the plate 2. As shown in FIG. 2, a front half 4*b* of the folded bank note 4 is inserted between the single segment and the rear face of the plate, and a rear half 4*a* of the bank notes is inserted between the double segment and the front face of the plate 2**.

A retaining ring 3 can be attached to any part of a user's clothes, whereby the safety bank note holder of the present invention can be affixed thereto for safely carrying the bank notes and easily drawing out required bank notes from the holder for use.

Figure 3:
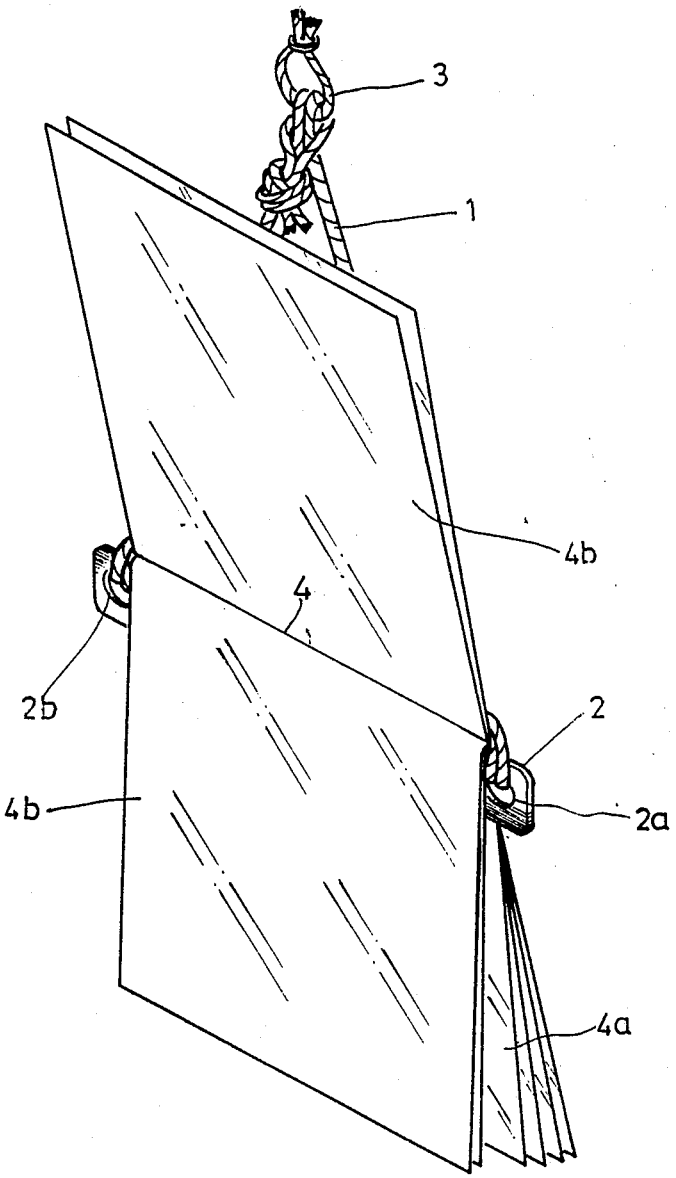
FIG. 3 is a view according to FIG. 2, illustrating that necessary amount of bank notes are to be drawn out from the bank note book.
Figure 4:
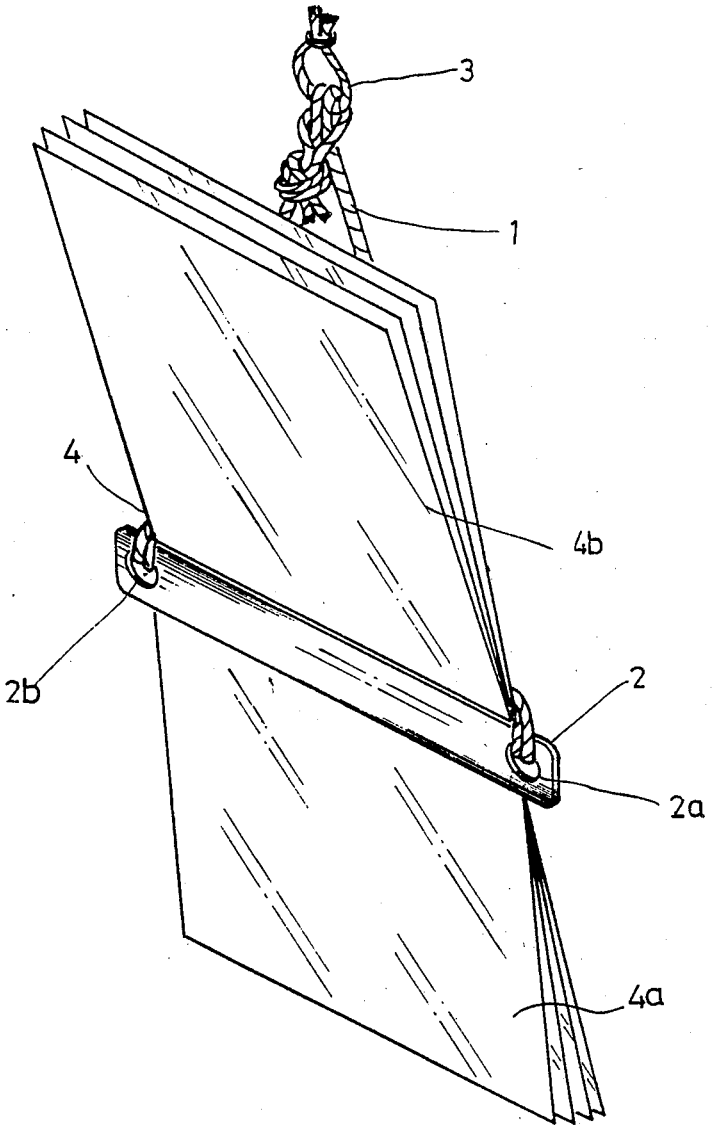
FIG. 4 is a view according to FIG. 2, illustrating that all the bank notes are to be drawn out from the present invention.

Please further refer to FIGS. 3 and 4,, illustrating a movements inserting and drawing the bank of notes. First, the bank notes of two different values are divided into two piles and each pile of bank notes is folded in two, and then, via loosening the front double segment of the rope, letting the front half **4*b* of bank notes inserted between the double segment of the rope and the front face, and then, via loosening the rear single segment of the rope, letting the rear half 4*a* of the bank notes inserted between the single segment and the rear face, the folded bank notes ride on and pinch the rectangular plate to be bound up by the front double segment and the rear single segment of the rope 1**.

When drawing out the bank notes, one should first loosen the double segment of the rope 1 at the front face of the rectangular plate 2 and take up the folded bank notes according to the amount required, and draw out the taken up bank notes from the rectangular plate 2 and the rope 1.

The distance between the holes **2*a* and 2*b*** is corresponding to the length of a short side of the bank note, whereby after folded in two, the bank note is allowed to suitably ride on said plate without easy slipping away.

More particularly, if the bank notes are bound up by the invention in the back pocket of the pants and the owner of the bank notes is walking or standing in a crowd of people, and in case the bank notes are drawn out by external force, the rope will be dragged to notice the owner of the bank notes of the matter so as to take necessary step to seize back the bank notes.

I claim:

1. A safety bank note holder for carrying personal bank notes, comprising a thin elastic long rectangular plate and a rope having two ends, said plate having a front face, a rear face, a first end formed with a first hole and a second end formed with a second hole, said rope being loosely tied to said plate in such a manner that one end of said rope is conducted through said first hole from said rear face to said front face of said plate, and drawn along said front face toward said second hole and conducted through said second hole back to said rear face, and then drawn along said rear face toward said first hole and again conducted through said first hole to said front face and then again drawn along said front face toward said second hole and again conducted through said second hole back to said rear face and tied with the other end of said two ends of said rope, forming a knot, whereby a single segment of said rope is formed on said rear face and a double segment of said rope is formed on said front face, permitting a bank note to be folded in two and ride on said plate with one half of the bank note inserted between said single segment and said rear face of said plate, and the other hald of the bank note inserted between said double segment and said front face of said plate so as to safely carry the bank note and easily draw out the bank note from said bank note holder for use.

2. A bank note holder as claimed in claim 1, wherein a distance between said first and second holes of said plate is corresponding to a short side of the bank note whereby after folded in two, the bank note is allowed to ride on said plate with one half of the bank note suitably inserted between said single segment and said rear face of said plate, and the other half of the bank note inserted between said double segment and said front face of said plate.

* * * * *